US006881031B2

(12) United States Patent
Nomura

(10) Patent No.: US 6,881,031 B2
(45) Date of Patent: Apr. 19, 2005

(54) CENTRIFUGAL AIR BLOWER

(75) Inventor: Tadahiro Nomura, Utsunomiya (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/606,359

(22) Filed: Jun. 26, 2003

(65) Prior Publication Data

US 2004/0062646 A1 Apr. 1, 2004

(30) Foreign Application Priority Data

Jun. 26, 2002 (JP) ..... 2002-186472

(51) Int. Cl.[7] ..... F01D 1/02
(52) U.S. Cl. ..... 415/203; 415/154
(58) Field of Search ..... 415/203–206, 415/119, 211.2, 224

(56) References Cited

U.S. PATENT DOCUMENTS 1,914,919 A * 6/1933 Heermans ..... 415/196
3,758,227 A * 9/1973 Pollak et al. ..... 415/182.1
4,789,301 A * 12/1988 Osborne et al. ..... 415/206
4,844,693 A * 7/1989 Grzina ..... 415/197
5,839,879 A * 11/1998 Kameoka et al. ..... 415/206
6,146,092 A * 11/2000 Botros et al. ..... 415/119
6,254,336 B1 * 7/2001 Ahn ..... 415/119
6,332,759 B1 * 12/2001 Guillemin et al. ..... 417/366
6,378,361 B1 * 4/2002 Larsen et al. ..... 73/147

FOREIGN PATENT DOCUMENTS

JP 07208396 A 8/1995

* cited by examiner

*Primary Examiner*—Edward K. Look
*Assistant Examiner*—James M. McAleenan
(74) *Attorney, Agent, or Firm*—Birch, Stewart, Kolasch & Birch, LLP

(57) ABSTRACT

A centrifugal air blower includes a fan having a plurality of blades spaced circumferentially therearound for generating an air flow. The fan is disposed in a main case which defines a first discharge passage for the air to flow therethrough. An extended case defining therein a second discharge passage, which has a cross-sectional area progressively greater toward an outlet thereof, is combined with the main case. An air guide means having an arcuately shaped surface for guiding air extends from the first and second discharge passages, in the main case and the extended case toward an outlet of the second discharge passage.

16 Claims, 6 Drawing Sheets

CENTRIFUGAL AIR BLOWER

BACKGROUND OF THE INVENTION

1. Field of the Invention

The present invention relates to a centrifugal air blower, and more particularly to a centrifugal air blower for use in an air-conditioning system in a vehicle.

2. Description of the Related Art

One conventional centrifugal air blower is illustrated in FIGS. 5 and 6 of the accompanying drawings. The conventional centrifugal air blower 1 in FIGS. 5 and 6, has a fan 3 rotatable by a motor 2 and a scroll casing 5 having a spirally shaped first discharge passage 4 extending around the fan 3 for forcing air into the passenger's compartment of a vehicle, for example, upon rotation of the fan 3. The scroll casing 5 comprises a main case 5*a* housing the motor 2 and the fan 3 therein, and an extended case 5*b* attached to the main case 5*a*.

The motor 2 is fixedly mounted on the main case 5*a* so as to extend through a lower wall of the main case 5*a*. The fan 3 is mounted on the rotatable shaft of the motor 2 and is accommodated substantially centrally in the main case 5*a*. The fan 3 comprises a plurality of blades 6 spaced at equal angular intervals around the circumference thereof, an annular holder ring 7*a* mounted on the upper ends of the blades 6, and a bottom plate 7*b* mounted on the lower ends of the blades 6.

The main case 5*a* comprises an upper plate 9 disposed above the fan 3 and having an air inlet 8 defined therein over the fan 3, a lower plate 10 disposed beneath the fan 3 vertically facing the upper panel 9, and an arcuate outer wall 11 joining the circumferential edges of the upper and lower plates 9, 10. As shown in FIG. 5, of the main case 5*a*, the cross-sectional area near a terminal position N of the first discharge passage 4 progressively increases toward the outlet, and the distance from the center of the fan 3 to the outer circumferential edge of the first discharge passage 4 progressively increases toward the outlet of the first discharge passage 4. The lower plate 10 comprises an annular panel 12 positioned near the bottom plate 7*b*, a spiral flat panel 13 disposed substantially perpendicularly to the outer wall 11, and a spiral joint panel 14 slanted downwardly from the annular panel 12 toward the outward direction of the fan 3.

The extended case 5*b* has a second discharge passage 15 defined therein which communicates with the outlet of the first discharge passage 4. The cross-sectional area of the second discharge passage 15 progressively increases toward its outlet from the outlet of the first discharge passage 4.

For reducing the overall size of the conventional centrifugal air blower 1, the second discharge passage 15 in the extended case 5*b*, for example, is vertically increased therefore allowing the scroll casing 5 to be compact. In this case, the vertical size of the second discharge passage 15 is increased from a position of the outer and inner walls, which can be connected by a line, i.e., from a position X of the outer wall and a position Y of the inner wall. Thus, the four sides of the vertical cross section of the second discharge passage 15 are formed with lines.

As shown in FIGS. 5 and 6 of the accompanying drawings, the extended case 5*b* defining the second discharge passage 15 therein, has an extended upper panel 16 which progressively spreads upwardly at an angle $\theta_{UP}$ from a position near a terminal position N of the spirally shaped main case 5*a*, and an extended lower panel 17 which progressively spreads downwardly at an angle $\theta_{LR}$ from an end portion of the shaft of the motor 2. The highest end of the extended upper panel 16 is higher that the upper panel 9 by a distance $H_{UP}$, and the lowest end of the extended lower panel 17 is lower than the annular panel 12 of the lower plate 10 by a distance $H_{LR}$.

If the ratio $H_{UP}/H_{LR}$ of the distance $H_{UP}$, which is the distance from the outer end of the extended upper panel 16 and the upper panel 9, and the distance $H_{LR}$, which is the distance from the outer end of the extended lower panel 17 to the annular panel 12 of the lower plate 10, is large, then swirling flows 18, 19 (see FIG. 6) are generated near the position X where vertical size of the outer wall starts to increase and near the position Y where vertical size of the inner wall starts to increase, causing an energy loss of the air that flows through the first and second discharge passages 4, 15. As a result, a large pressure loss may occur in the conventional centrifugal air blower 1, and the conventional centrifugal air blower 1 tends to produce large noise.

If the positions X, Y are displaced upstream of the first discharge passage 4, then the angle $\theta_{LR}$, by which the extended lower panel 17 is progressively spread downwardly, is reduced, possibly reducing the swirling flows 18, 19 produced at the positions X, Y. However, since the vertical positional difference between the bottom plate 7*b* of the fan 3 and the flat panel 13 is increased, a swirling flow 20 is liable to be developed. Consequently, the amount of air discharged from the conventional centrifugal air blower 1 is reduced due to a pressure loss caused thereby, and increased noise is generated by the conventional centrifugal air blower 1.

SUMMARY OF THE INVENTION

It is a major object of the present invention to provide a centrifugal air blower which allows discharged air to flow smoothly and reduces swirling flows produced therein.

According to the present invention, a centrifugal air blower has an air guide means for guiding air in a discharge passage, the air guide means having an arcuately shaped surface extending along the discharge passage for allowing air to flow smoothly to reduce swirling flows in the air. Pressure loss caused in the discharge passage and noise is greatly reduced.

Another object of the present invention is to provide a centrifugal air blower which includes an extended case having a discharge passage defined therein and having a cross-sectional area which progressively increases, and an air guide means disposed in the discharge passage for guiding air in a discharge passage. The air guide means has an arcuately shaped surface extending along the discharge passage.

Still another object of the present invention is to provide a centrifugal air blower which has an air guide means for guiding air, the air guide means having an edge at a position to start increasing the vertical size of an outer wall of an extended case and an opposite edge at a position to start increasing the vertical size of an inner wall of the extended case, the former position being positioned upstream of the latter position.

Yet another object of the present invention is to provide a centrifugal air blower which has an air guide means for guiding air, the air guide means having an arcuately shaped surface which has a radius of curvature near an outer wall of an extended case and a radius of curvature near an inner wall of the extended case, the former radius of curvature being greater than the latter radius of curvature.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A centrifugal air blower according to a preferred embodiment of the present invention will be described in detail below with reference to FIGS. 1 through 4.

Figure 1:
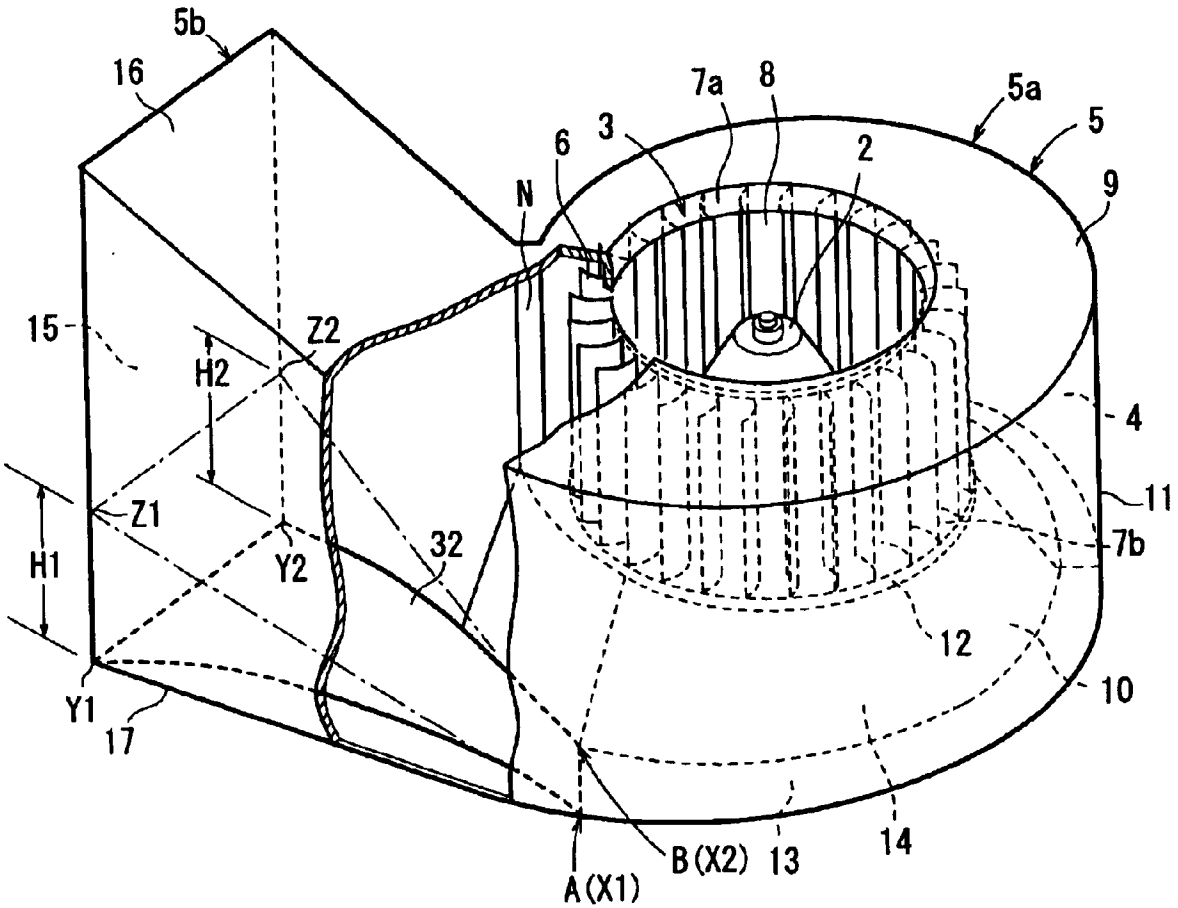
FIG. 1 is a perspective view, partly cut away, of a centrifugal air blower according to an embodiment of the present invention.
Figure 5:
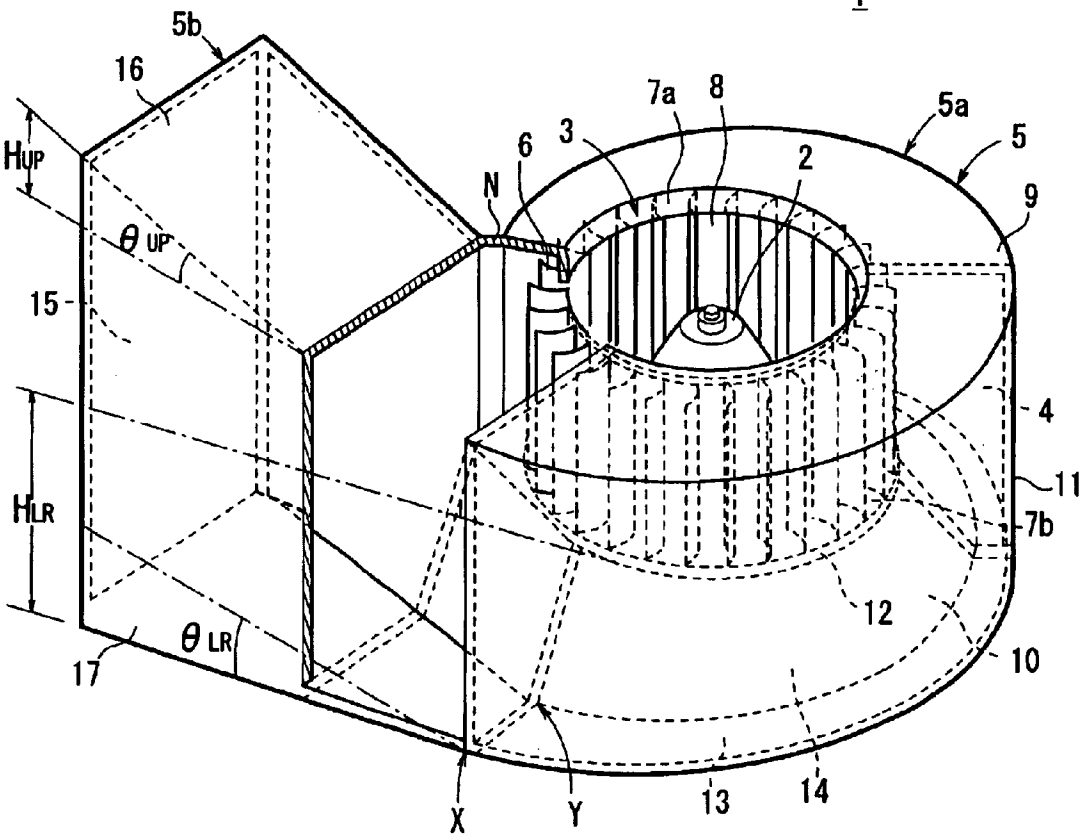
FIG. 5 PRIOR ART
FIG. 5 is a perspective view, partly cut away, of a conventional centrifugal air blower.
Figure 6:
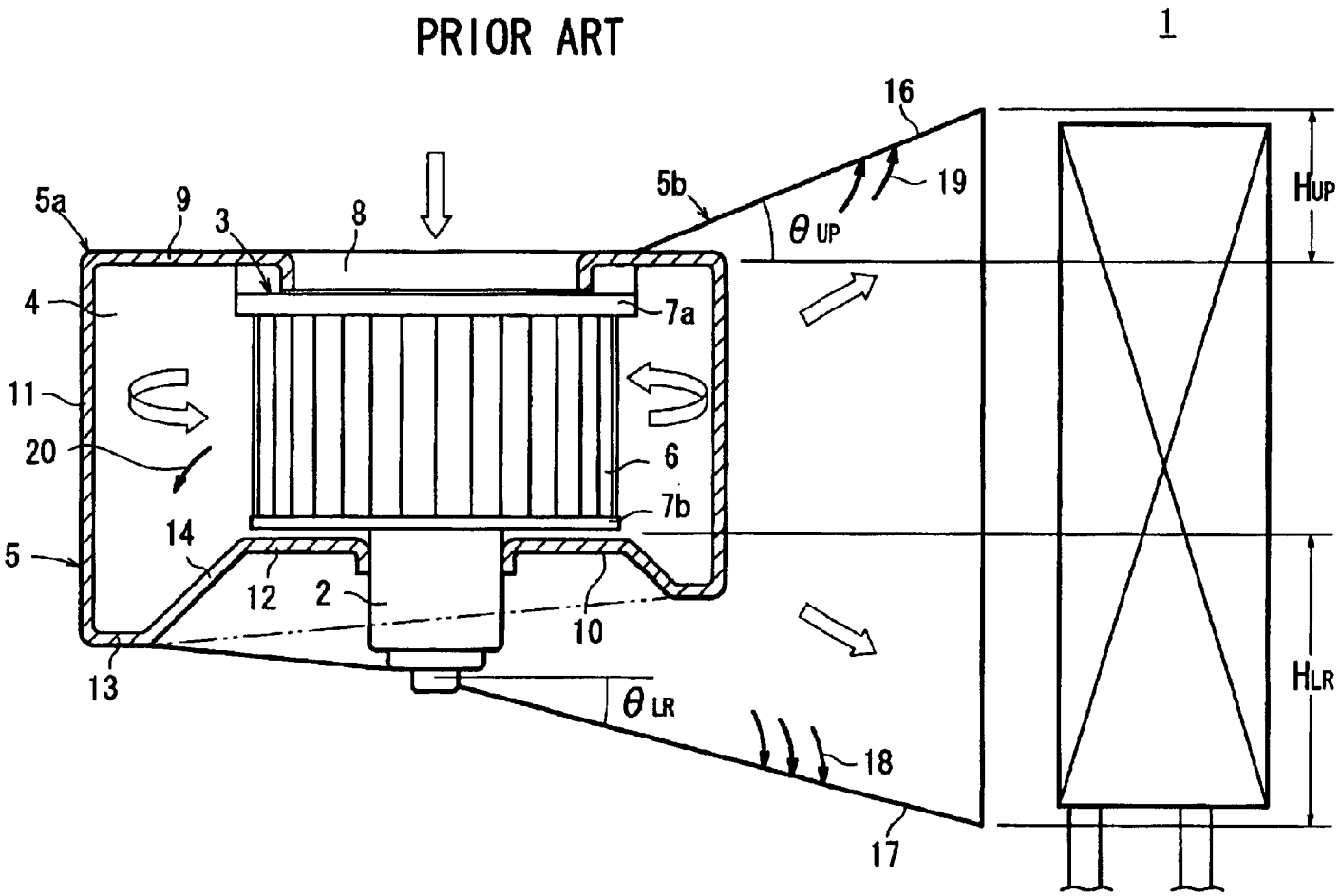
FIG. 6 PRIOR ART
FIG. 6 is a cross-sectional view of the conventional centrifugal air blower shown in FIG. 5.

FIG. 1 shows in perspective, partly cut away, a centrifugal air blower 30 according to a preferred embodiment of the present invention. Those parts of the centrifugal air blower 30, which are identical to those of the conventional centrifugal air blower shown in FIGS. 5 and 6, are designated by identical reference characters, and will not be described in detail below.

As shown in FIG. 1, the centrifugal air blower 30 has an air guide means 32 disposed in first and second discharge passages 4, 15 in a main case 5*a* and an extended case 5*b*. The air guide means 32 has an end starting from the first discharge passage 4 in the main case 5*a*. The air guide means 32 has a body integrally combined with an upper end surface of an extended lower panel 17, and essentially providing the second discharge passage 15 in the extended case 5*b*.

Figure 2:
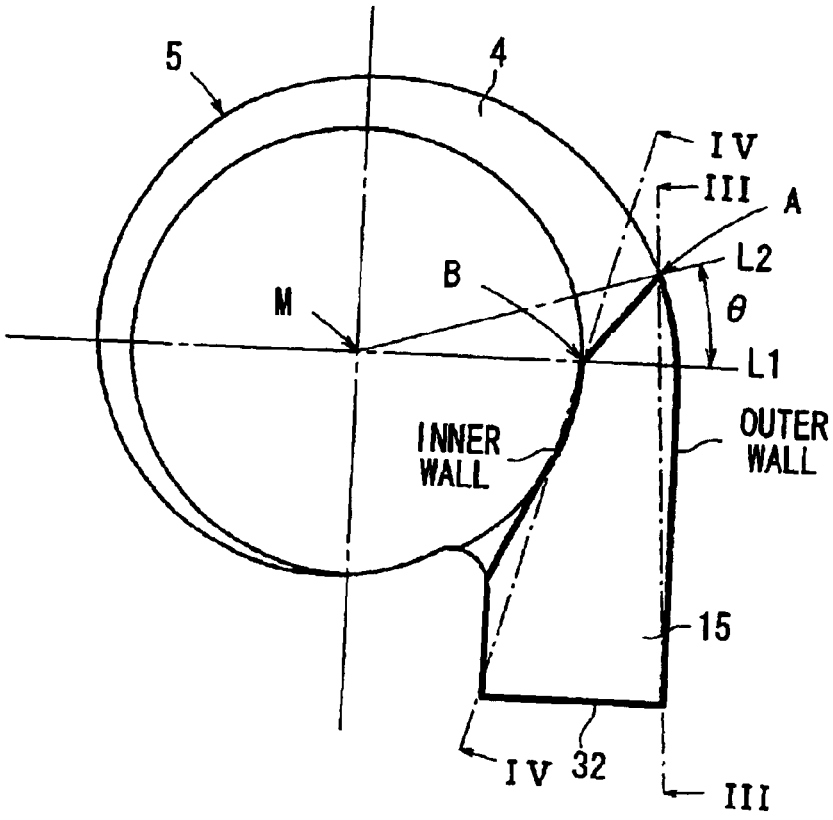
FIG. 2 is a view showing the positional relationship between a discharge passage in a scroll casing and an air guide means.

As shown in FIG. 2, the end of the air guide means 32 positioned upstream in the first discharge passage 4 has an edge at a position A to start increasing the vertical size of the outer wall and an opposite edge at a position B to start increasing the vertical size of the inner wall. The position A is positioned an angle θ upstream of the position B. The angle θ is formed between a straight line L1 which connects the center M of a motor 2 and the position B, and a straight line L2 which connects the center M of the motor 2 and the position A.

Figure 3:
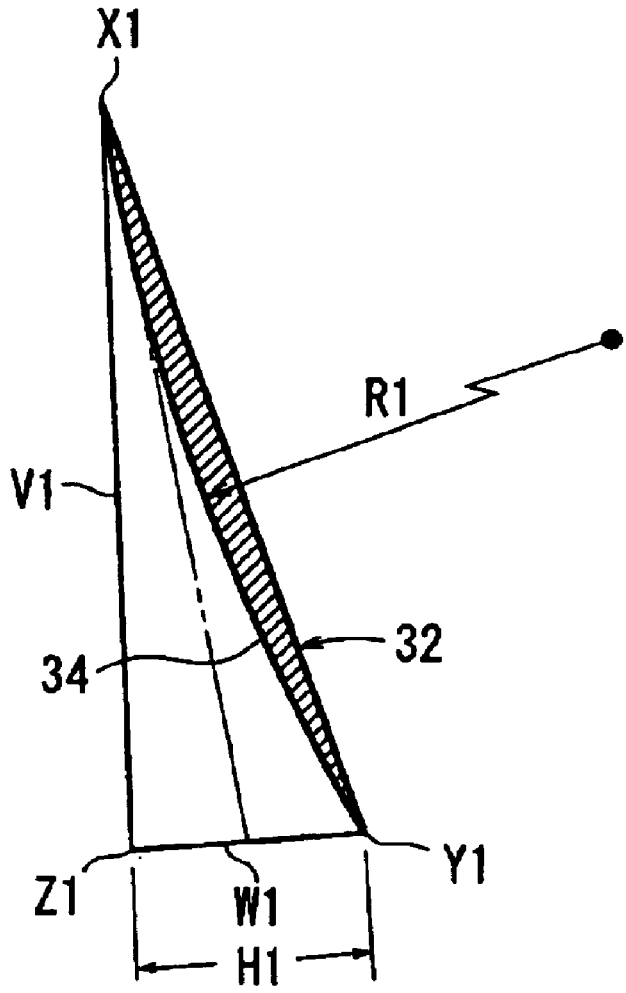
FIG. 3 is a cross-sectional view taken along line III—III of FIG. 2.
Figure 4:
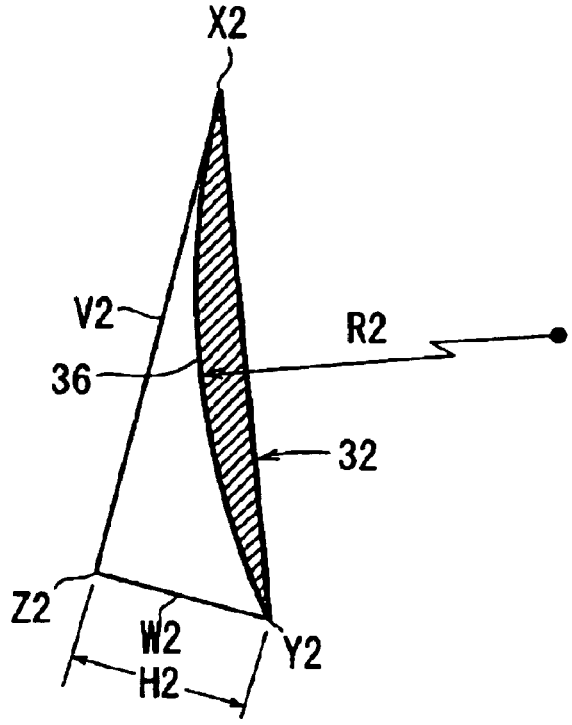
FIG. 4 is a cross-sectional view taken along line IV—IV of FIG. 2.

As shown in FIGS. 3 and 4, the air guide means 32 has an arcuate longitudinal section and includes an curved surface 34 near the outer wall and an curved surface 36 near the inner wall, the curved surfaces 34, 36 have different radii R1, R2 of curvature, respectively. The position B is located downstream of the position A.

Specifically, ratios of the radius R1 of curvature of the curved surface 34 near the outer wall and the radius R2 of curvature of the curved surface 36 near the inner wall are set to values shown in Table 1 below. By setting the ratios, air flows smoothly in the first and second discharge passages 4, 15 which efficiently reduces pressure losses in the first and second discharge passages 4, 15 and noise produced by the centrifugal air blower 30.

TABLE 1

| | R1 (mm) | R2 (mm) | R1/R2 |
|---|---|---|---|
| (1) | 600 | 190 | 3.15 |
| (2) | 720 | 230 | 3.13 |
| (3) | 610 | 210 | 2.90 |

In the centrifugal air blower 30, the position A on the end of the air guide means 32 is located upstream of the position B on the end of the air guide means 32, and the upper surface of the air guide means 32 is curved for reducing swirling flows in the air discharged from the fan 3 and the air flowing in the first and second discharge passages 4, 15.

In FIG. 3, it is assumed that a line V1 tangential to an end X1 of the curved surface 34 and a straight line W1, which passes through the other end Y1 of the curved surface 34 and is perpendicular to the tangential line V1, intersect at a point Z1, and the other end Y1 is spaced from the point Z1 by a distance H1.

In FIG. 4, it is assumed that a line V2 tangential to an end X2 of the curved surface 36 and a straight line W2, which passes through the other end Y2 of the curved surface 36 and is perpendicular to the tangential line V2 intersect at a point Z2, and the other end Y2 is spaced from the point Z2 by a distance H2.

The distances H1, H2 are the same, and are determined by the area of an opening, which depends on the rate of air discharged through the second discharge passage 15 shown in FIG. 1. The arcuate shape of the air guide means 32 near the outer wall is set such that the radius R1 of curvature near the outer wall is greater than the radius R2 of curvature near the inner wall, so that the position A will not be displaced downstream.

As described above, the centrifugal air blower according to the present invention has the air guide means whose outer surface has an arcuate shape, which enables air to flow smoothly to reduce swirling flows therein. Therefore, pressure losses in the discharge passages and noise are greatly reduced.

In the illustrated embodiment, the air guide means 32 is integrally combined with the second discharge passage 15. However, the air guide means 32 may be separate from the second discharge passage 15 and disposed within the second discharge passage 15.

In the illustrated embodiment, the air guide means 32 is disposed on the upper end surface of the extended lower panel 17, i.e., on the bottom surface of the second discharge passage 15. However, the air guide means 32 may be disposed on a lower end surface of the extended upper panel 16, i.e., on the ceiling surface of the second discharge passage 15, or may be disposed on both the upper end surface of the extended lower panel 17 and the lower end surface of the extended upper panel 16.

Further, the radii R1, R2 of curvature of the arcuately curved surfaces 34, 36 near the outer and inner walls may be the same.

Furthermore, the positions A, B at the opposite edges of the end of the air guide means 32 may be aligned for reducing swirling flows in the air flowing through the second discharge passage 15.

Although a certain preferred embodiment of the present invention has been shown and described in detail, it should be understood that various changes and modifications may be made therein without departing from the scope of the appended claims.

What is claimed is:

1. A centrifugal air blower comprising:

a fan having a plurality of blades spaced circumferentially therearound for generating an air flow;

a scroll casing, said fan being positioned within said scroll casing and said scroll casing defining a first discharge passage for flowing air therethrough;

an extended case connected to said first discharge passage in said scroll casing and defining therein a second discharge passage which cross-sectional area progressively increases toward an outlet thereof; and air guide means for guiding air in said second discharge passage, said air guide means having an arcuately shaped surface extending along at least one of a bottom surface and a ceiling surface of said second discharge passage defined in said extended case for decreasing the cross-sectional area of the second discharge passage.

2. A centrifugal air blower according to claim 1, wherein said air guide means has an edge at a position A to start increasing the vertical size of an outer wall of said extended case and an opposite edge at a position B to start increasing the vertical size of an inner wall of the extended case, said position A being positioned upstream of said position B.

3. A centrifugal air blower according to claim 1, wherein said arcuately shaped surface of said air guide means has a radius R1 of curvature near an outer wall of the extended case and a radius R2 of curvature near an inner wall of the extended case, said radius R1 of curvature being greater than said radius R2 of curvature.

4. A centrifugal air blower according to claim 3, wherein a ratio R1/R2 between said radius R1 of curvature near the outer wall of said extended case and said radius R2 of curvature near the inner wall of said extended case ranges from 2.90 to 3.15.

5. A centrifugal air blower according to claim 1, wherein said air guide means is disposed on a bottom surface of said second discharge passage.

6. A centrifugal air blower according to claim 1, wherein said air guide means is disposed on a ceiling surface of said second discharge passage.

7. A centrifugal air blower according to claim 1, wherein said air guide means is disposed on both a bottom surface and a ceiling surface of said second discharge passage.

8. A centrifugal air blower according to claim 1, wherein said air guide means is integral with said extended case and disposed in said second discharge passage.

9. A centrifugal air blower according to claim 1, wherein said air guide means is separate from said extended case and fixed to said second discharge passage.

10. A centrifugal air blower comprising:

a fan having a plurality of blades spaced circumferentially therearound for generating an air flow;

a scroll casing, said fan being positioned within said scroll casing and said scroll casing defining a first discharge passage for flowing air therethrough;

an extended case connected to said first discharge passage in said scroll casing and defining therein a second discharge passage which cross-sectional area progressively increases toward an outlet thereof; and air guide means for guiding air in said second discharge passage, said air guide means having an arcuately shaped surface extending along said second discharge passage defined in said extended case, said arcuately shaped surface of said air guide means has a radius R1 of curvature near an outer wall of the extended case and a radius R2 of curvature near an inner wall of the extended case, said radius R1 of curvature being greater than said radius R2 of curvature and a ratio R1/R2 ranges from 2.90 to 3.15.

11. A centrifugal air blower according to claim 10, wherein said air guide means has an edge at a position A to start increasing the vertical size of an outer wall of said extended case and an opposite edge at a position B to start increasing the vertical size of an inner wall of the extended case, said position A being positioned upstream of said position B.

12. A centrifugal air blower according to claim 10, wherein said air guide means is disposed on a bottom surface of said second discharge passage.

13. A centrifugal air blower according to claim 10, wherein said air guide means is disposed on a ceiling surface of said second discharge passage.

14. A centrifugal air blower according to claim 10, wherein said air guide means is disposed on both a bottom surface and a ceiling surface of said second discharge passage.

15. A centrifugal air blower according to claim 10, wherein said air guide means is integral with said extended case and disposed in said second discharge passage.

16. A centrifugal air blower according to claim 10, wherein said air guide means is separate from said extended case and fixed to said second discharge passage.

* * * * *